US010457454B2

(12) United States Patent
Wu

(10) Patent No.: US 10,457,454 B2
(45) Date of Patent: Oct. 29, 2019

(54) CONTAINER

(71) Applicant: Kuo-Cheng Wu, Kaohsiung (TW)

(72) Inventor: Kuo-Cheng Wu, Kaohsiung (TW)

( * ) Notice: Subject to any disclaimer, the term of this patent is extended or adjusted under 35 U.S.C. 154(b) by 38 days.

(21) Appl. No.: 15/696,340

(22) Filed: Sep. 6, 2017

(65) Prior Publication Data

US 2019/0071226 A1 Mar. 7, 2019

(51) Int. Cl.
*B65D 51/28* (2006.01)
*B65D 85/72* (2006.01)
*B65D 41/04* (2006.01)

(52) U.S. Cl.
CPC ..... *B65D 51/2864* (2013.01); *B65D 41/04* (2013.01); *B65D 85/72* (2013.01)

(58) Field of Classification Search
CPC ..... B65D 51/2864; B65D 51/2871; B65D 51/2827; B65D 51/28; B65D 85/72; B65D 51/2857
USPC ..... 206/219, 221, 222
See application file for complete search history.

(56) References Cited

U.S. PATENT DOCUMENTS 3,326,363 A * 6/1967 Bennett ..... B65D 51/28 206/219
4,785,931 A * 11/1988 Weir ..... B65D 51/2835 206/222
6,959,841 B2 * 11/2005 Vlodek ..... B65D 51/28 206/219
6,976,578 B1 * 12/2005 Kenihan ..... B65D 51/2835 206/219
8,376,134 B1 * 2/2013 Underwood ..... B65D 51/2892 206/221
8,443,970 B2 * 5/2013 Coon ..... B65D 51/2835 206/219
8,453,833 B2 * 6/2013 Porter ..... B65D 1/2871 206/222
8,453,834 B2 * 6/2013 Porter ..... B65D 51/2871 206/222
9,290,309 B1 * 3/2016 Pabon ..... A47G 19/2272
2008/0202951 A1 * 8/2008 Landolt ..... B65D 47/241 206/222
2010/0044377 A1 * 2/2010 Porter ..... B65D 51/2828 220/212

(Continued)

FOREIGN PATENT DOCUMENTS

TW M331501 5/2008

*Primary Examiner* — Steven A. Reynolds
(74) *Attorney, Agent, or Firm* — Rosenberg, Klein & Lee

(57) ABSTRACT

An improved container includes a body, a cap, and operating sets movably inserted into the body. The body has a first accommodation area for accommodating a main material. The cap has a bottom wall, a side wall extending from the bottom wall to enclose a second accommodation area, and a partitioning wall dividing the second accommodation area into accommodation rooms. Each operating set has a shank, two ends of which are respectively formed with a head protruding from the cap and a sealing plate engaging with the partitioning wall for sealing each accommodation room. Pressing any selected one head allows the selected sealing plate to separate from the partitioning wall so that at least selected one second material of the selected accommodation room enters the first accommodation area for mixing different materials in the body and increasing variability and selectivity of using the improved container.

8 Claims, 7 Drawing Sheets

(56) References Cited

U.S. PATENT DOCUMENTS

| | | | | |
|---|---|---|---|---|
| 2012/0074003 | A1* | 3/2012 | Sheehan | B65D 51/2857 206/219 |
| 2012/0168326 | A1* | 7/2012 | Pannu | B65D 51/2835 206/219 |

* cited by examiner

CONTAINER

BACKGROUND OF THE INVENTION

1. Field of the Invention

This invention relates to a container and relates particularly to an improved container capable of varying material combination and changing mixing order of different materials according to needs to increase variability and selectivity.

2. Description of the Related Art

Generally, a conventional container has only one accommodation room for receiving one kind of materials. If additional materials are required, all of the materials should be mixed in advance of filling into the container to cause great inconvenience.

Referring to FIG. 1 and FIG. 2, a Taiwan Utility Model No. M331501 disclosing a cover-improved structure 1 with dunked content comprises a bottle 11 and a main cap 12 covering on the bottle 11. The bottle 11 has an accommodation area 111 formed inside the bottle 11. The main cap 12 has a bottom cap 121 with a first end 121A and a second end 121B, a top cap 122 threading into the first end 121A of the bottom cap 121, and a membrane 123 disposed on the second end 121B of the bottom cap 121. The bottom cap 121 has a connecting portion 1211 disposed around the bottom cap 121 near the second end 121B and at least one hook 1212 adjacent to the connecting portion 1211. Further, the second end 121B is inclined to the first end 121A. The top cap 122 has a bottom surface 1221, a side surface 1222 extending outwards from the bottom surface 1221, a hollow cutting unit 1223 extending outwards from the bottom surface 1221 and enclosed by the side surface 1222, an engagement portion 1224 disposed on a periphery of the side surface 1222, and at least one pressurization ring 1225 disposed in the side surface 1222 and situated between the bottom surface 1221 and the engagement portion 1224. The end of the cutting unit 1223 is parallel to the second end 121B of the bottom cap 121. Therefore, the engagement portion 1224 of the top cap 122 engages with the hook 1212 of the bottom cap 121 when the top cap 122 inserts into the bottom cap 121. Further, the membrane 123 is scarified when the top cap 122 is rotated to allow the end of the cutting unit 1223 to cut the membrane 123. In other words, the end of the cutting unit 1223 is rotated to be not parallel to the second end 121B of the bottom cap 121 to cut the membrane 123. Thus, a material within the cutting unit 1223 is allowed to enter the accommodation area 111 of the bottle 11 and mix with a material within the accommodation area 111.

However, the main cap 12 is disposed on the on the bottle 11 in advance of leaving the factory. The end of the cutting unit 1223 is arranged parallel to the second end 121B of the bottom cap 121 when the top cap 122 is disposed on the bottom cap 121 in the factory to prevent the cutting unit 1223 from cutting the membrane 123 which is disposed at the second end 121B. Therefore, the user can break the membrane 123 by rotating the top cap 122 to allow the cutting unit 1223 to cut the membrane 123. However, the material within the cutting unit 1223 may mix with the material within the accommodation area 111 accidentally by improper pressing of other force caused during the transportation or caused by people who do it with curiosity. Hence, customer may refuse to buy the container which is filled with mixed materials. Moreover, the main cap 12 only has one hollow cutting unit 1223 for accommodating one kind of ingredients and the bottle 11 also has one accommodation area 111 for accommodating one kind of materials. In other words, the container can only be applied to mix two kinds of materials. Thus, the adaptability of the container is poor if a mixture including more than two kinds of materials is preferred.

SUMMARY OF THE INVENTION

The object of this invention is to provide an improved container capable of accommodating and separating multiple materials in order to allow the varied material combination and mixing order, thereby increasing the variability and selectivity and avoiding accidental mixing of material.

The improved container of this invention includes a body, a cap connected to the body, and a plurality of operating sets movably protruding into the cap respectively. The body has a first accommodation area formed in the body for accommodating a main material and a first opening communicating with the first accommodation area and covered by the cap. The cap has a bottom wall, a side wall extending outwards from the bottom wall to define a second accommodation area, and a partitioning wall extending outwards from the bottom wall to divide the second accommodation area into a plurality of accommodation rooms for accommodating second materials. Each operating set has a shank, a sealing plate fitted at one end of the shank and capable of engaging with the partitioning wall, and a head fitted at one end of the shank and penetrating from the cap. Hence, each sealing plate engages with the partitioning wall to seal each accommodation room and to prevent each accommodation room from communicating with the first accommodation area. Thus, the user can press any selected head to separate the selected sealing plate from the partitioning wall and allow the selected second material of the selected accommodation room to drop into the first accommodation area. Therefore, the user can decide the mixing order or the material combination at will. Whereby variability and selectivity are increased.

Preferably, each operating set has a protecting unit fitted on the shank and located between the head and the bottom wall of the cap when the sealing plate of the operating set is placed in position.

Preferably, the heads of the operating units are on a same level when the sealing plates of the operating sets are respectively placed in position.

DETAILED DESCRIPTION OF THE PREFERRED EMBODIMENTS

Figure 1:
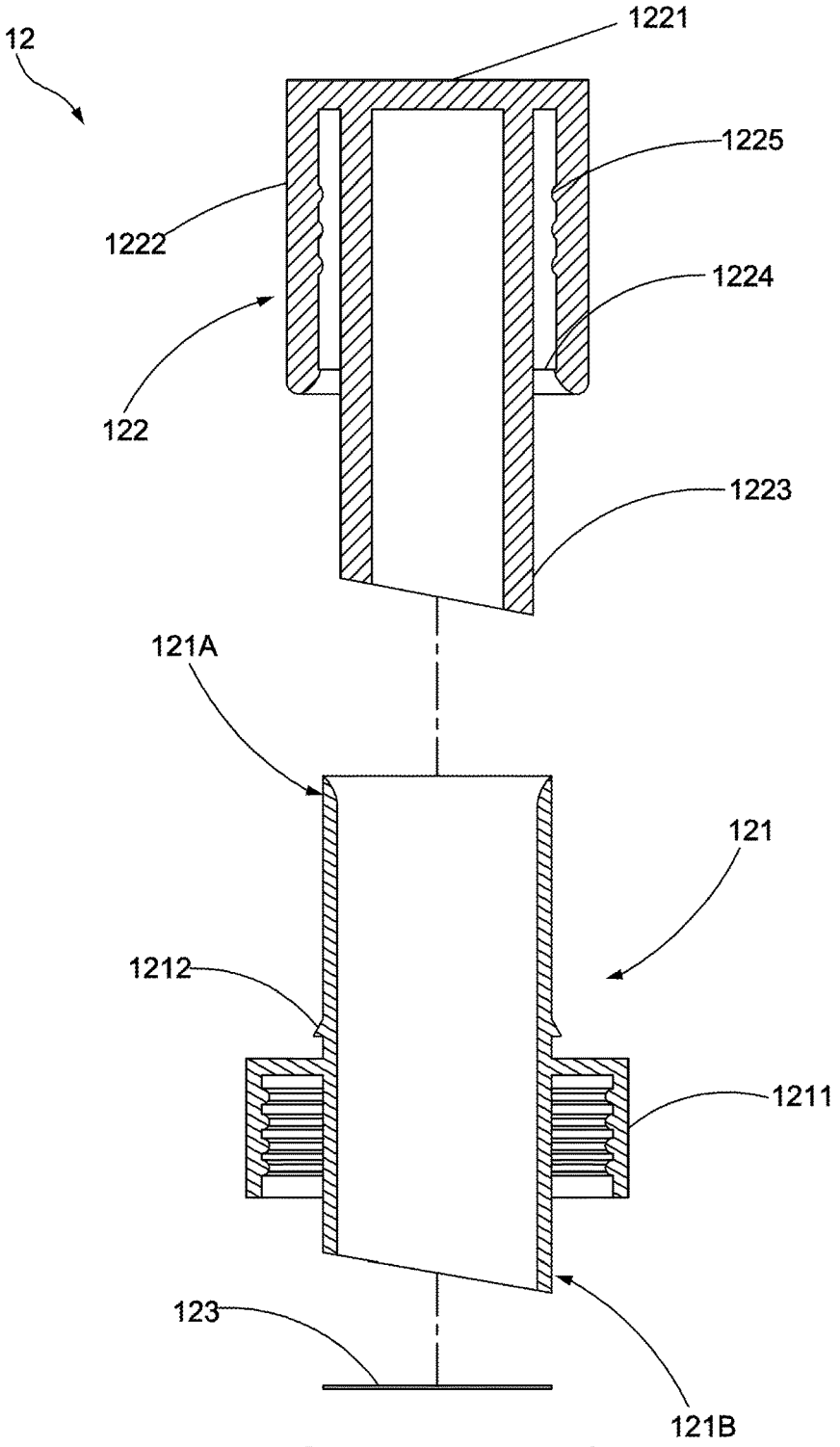
FIG. 1 (Prior art)
FIG. 1 is a schematic view showing a partial element of a conventional container.
Figure 2:
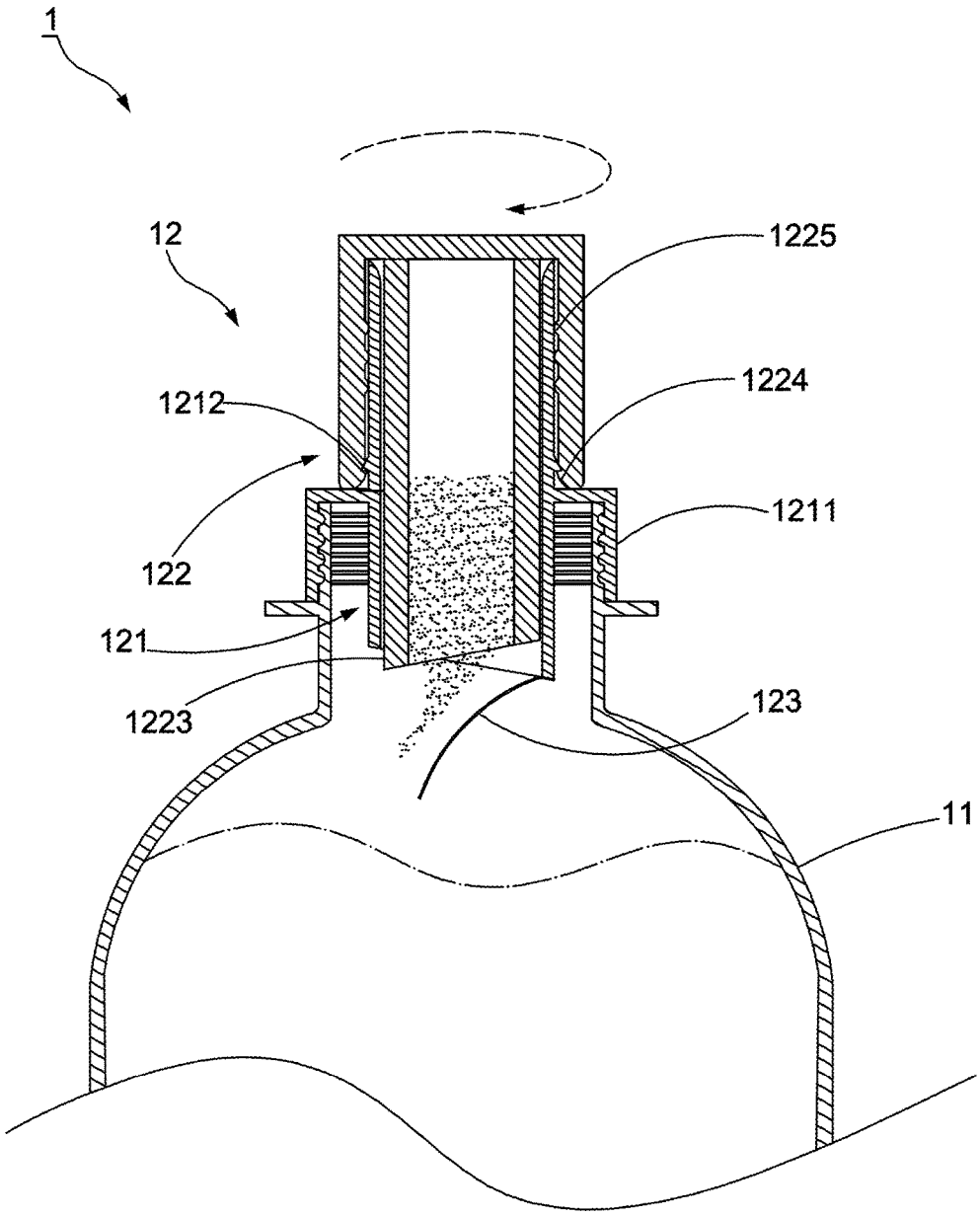
FIG. 2 (Prior art)
FIG. 2 is a schematic view showing how the conventional container operates.
Figure 3:
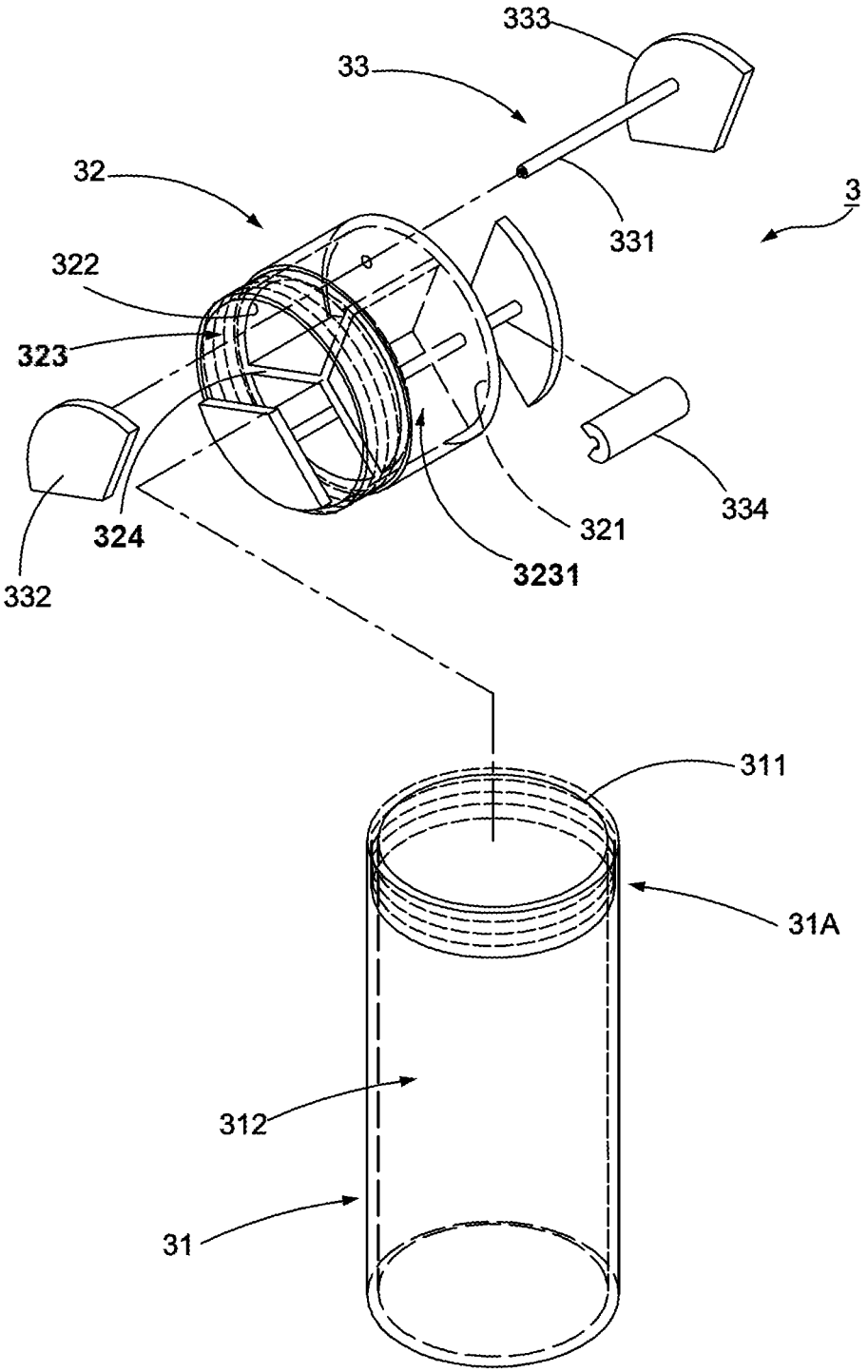
FIG. 3 is an exploded view showing a first preferred embodiment of this invention.
Figure 4:
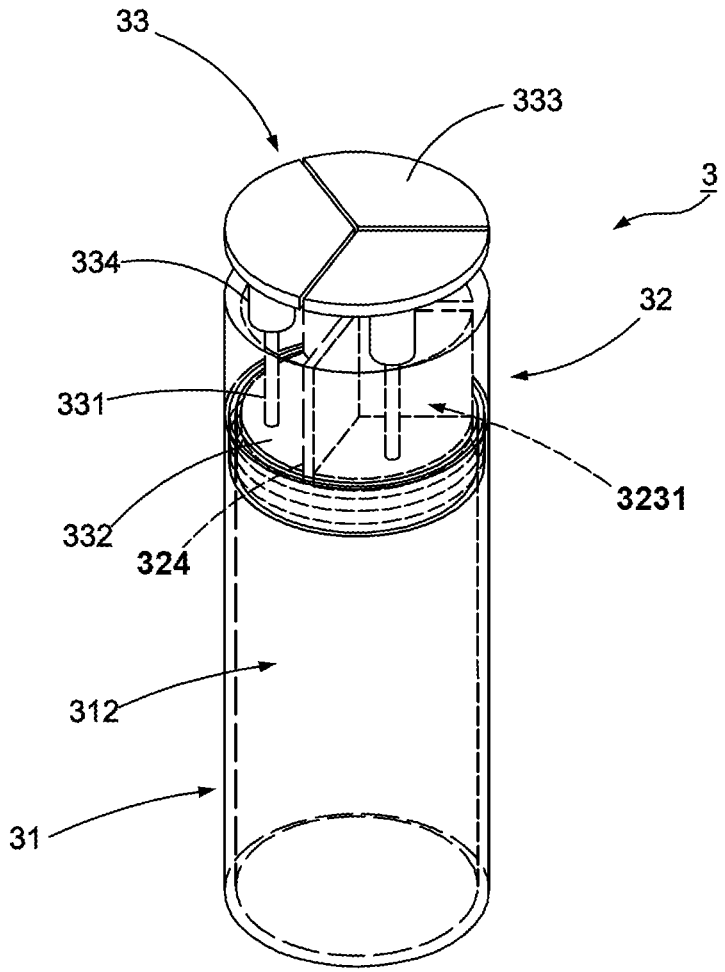
FIG. 4 is a schematic view showing that the cap engages with the body.
Figure 5:
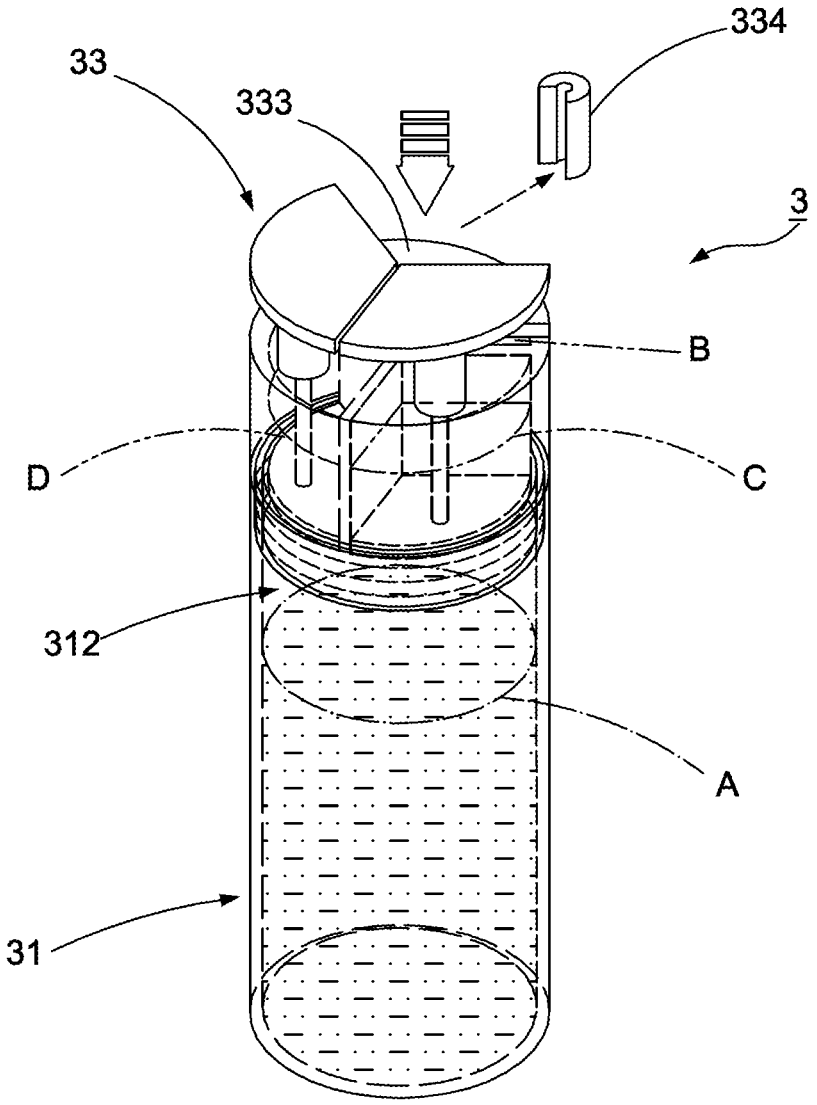
FIG. 5 is a schematic view showing that one of the selected operating sets is pressed downwards.

Referring to FIG. 3 and FIG. 4, a first preferred embodiment of an improved container 3 of this invention includes a body 31 defined an engagement end 31A, a cap 32 formed separately and connected to the body 31, and a plurality of operating sets 33 threading through the cap 32 and movably introducing into the cap 32 respectively. The body 31 has a first opening 311 enclosed by the engagement end 31A and covered by the cap 32 and a first accommodation area 312 extending downwards from the first opening 311 for filling a main material A, as shown in FIG. 5. The cap 32 has a bottom wall 321 relative to the first opening 311, a side wall 322 extending outwards from the bottom wall 321 and capable of engaging with the engagement end 31A, a second accommodation area 323 enclosed by the bottom wall 321 and the side wall 322, and partitioning wall 324 extending outwards from the bottom wall 321. The partitioning wall 324 separates the second accommodation area 323 into a plurality of independent accommodation rooms 3231 for accommodating multiple second materials. In this preferred embodiment, it is taken as an example that the partitioning wall 324 divides the second accommodation area 323 into three accommodation rooms 3231 which are filled with different second materials B` C` D respectively, as shown in FIG. 5.

Each operating set 33 has a shank 331 movably projecting into each accommodation room 3231, a sealing plate 332 connected to one end of the shank 331 and capable of engaging with the partitioning wall 324, and a head 333 connected to another end of the shank 331 and projecting from the cap 32. Each accommodation room 3241 is disposed with one operating set 33. Hence, each sealing plate 332 engages with the partitioning wall 324 to seal each accommodation room 3231 and to prevent each accommodation room 3231 from communicating with the first accommodation area 312. In other words, the second materials B` C` D accommodated within the accommodation rooms 3231 are prevented from mixing with the main material A which is accommodated within the first accommodation area 312. Only when the sealing plates 332 separate from the partitioning wall 324 to unseal each accommodation room 3231, communicate the accommodation rooms 3231 with the first accommodation area 312. Here takes an example that each operating set 33 further has a protecting unit 334 disposed on the shank 331 and situated between the head 333 and the bottom wall 321 of the cap 32 when the sealing plate 332 of the operating set 33 is placed in position. Therefore, the protecting unit 334 prevents each head 333 from being pressed accidentally by other force when the improved container 3 is displayed for selling or transported on the way to a store.

Referring to FIG. 3 to FIG. 5, in use of the improved container 3, the user fills the first accommodation area 312 with the main material A which can be coffee, tea, juice, alcoholic liquid and so on. Further, the user pushes all of the heads 333 toward a direction of the bottom wall 321 of the cap 32 to move each shank 331 and each sealing plate 332 downwards simultaneously. Each sealing plate 332 then separates from the partitioning wall 324 to allow each accommodation room 3231 to communicate with the outside. The user can fill each accommodation room 3231 with the second materials B` C` D respectively. The second materials B` C` D can be same ingredients or different ingredients, such as treacle, tapioca pearls, jelly or ingredients what the user prefers to combine with the main material A. Further, the user pulls each head 333 upwards to move the shank 331 and the sealing plate 332 simultaneously. Each sealing plate 332 then engages with the partitioning wall 324 and seals each accommodation room 3231, thereby preventing each accommodation room 3231 from communicating with the first accommodation area 312. When the cap 32 is disposed on the body 31, the protecting unit 334 is fitted on each shank 331 between the head 333 and the bottom wall 321 of the cap 32. Therefore, each protecting unit 334 prevents the head 333 from being pressed accidentally and ensures that the second materials B` C` D will not mix with the main material A in advance of selling. Thus, the beforehand filling operation of the improved container 3 is completed.

Figure 6:
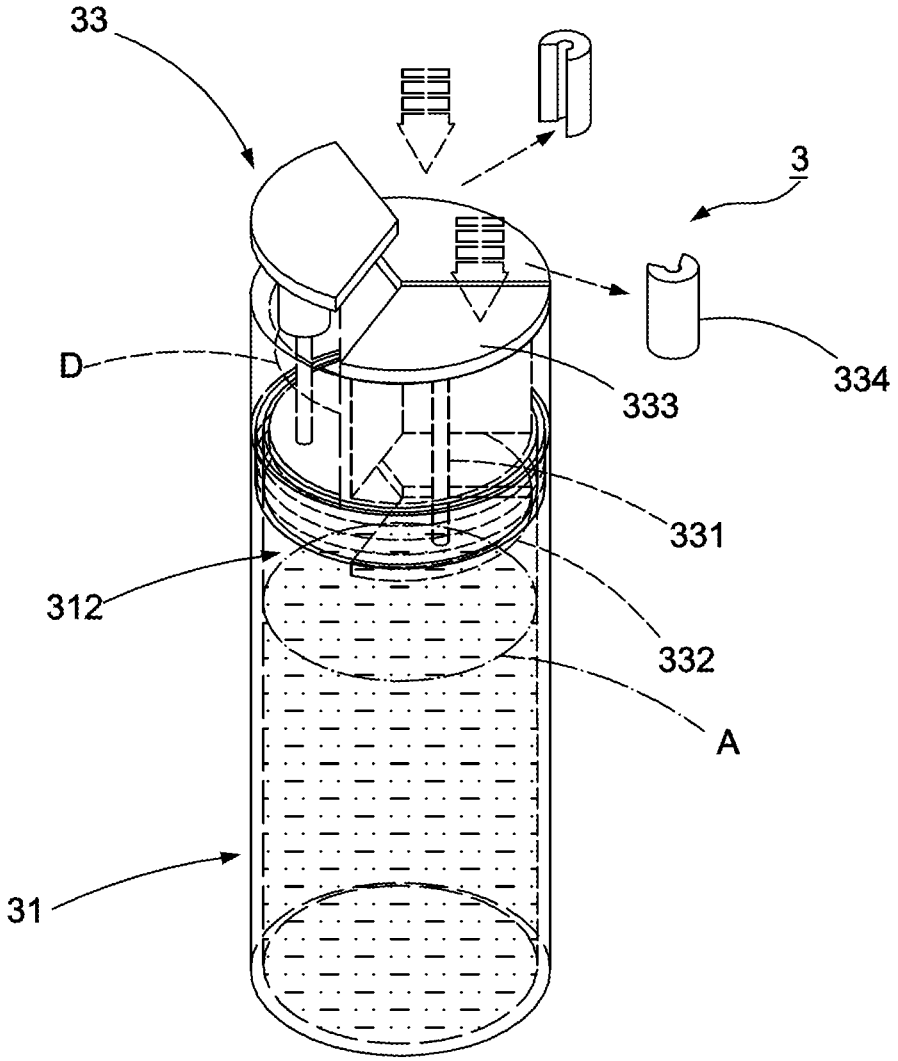
FIG. 6 is a schematic view showing that two of the selected operating sets are pressed downwards.
Figure 7:
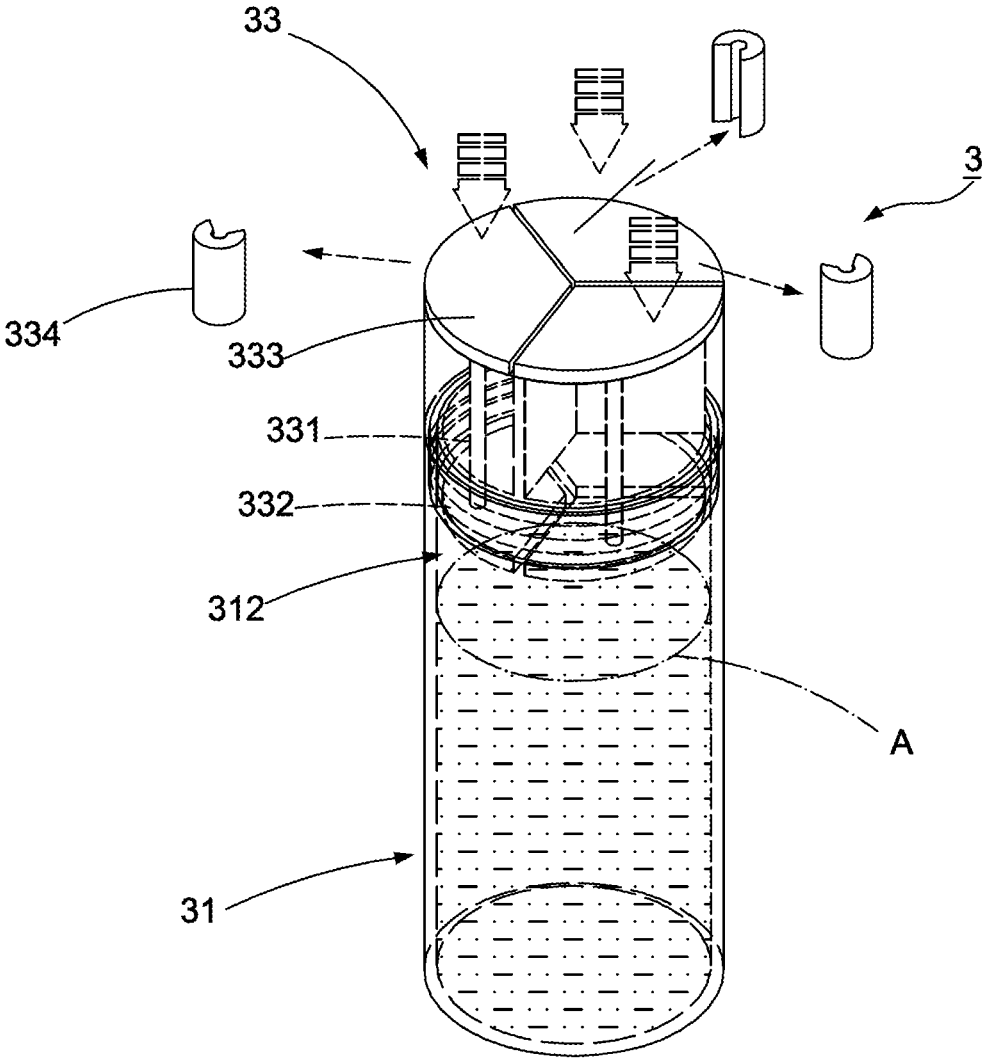
FIG. 7 is an exploded view showing that all of the operating sets are pressed downwards.

After the user purchases the improved container 3, the user can decide the material combination or mixing order of the second materials B` C` D and the main material A at will. If the user prefers to combine the main material A with one of the second materials B, the user removes the selected protecting unit 334 and presses the selected operating set 33 disposed in the accommodation room 3231 which accommodates the second material B, as shown in FIG. 5. In other words, the user presses the selected head 333 downwards to move the selected shank 331 and the selected sealing plate 332 simultaneously. The selected sealing plate 332 further separates from the partitioning wall 324 to communicate the selected accommodation room 3231 with the first accommodation area 312. Then, the selected second material B enters into the first accommodation area 312 and mixes with the main material A. Referring to FIG. 6 and FIG. 7, the user repeats the aforesaid operation to separate another selected sealing plate 332 from the partitioning wall 324 and allow another selected accommodation room 3231 to communicate with the first accommodation area 312 if the user prefers to add the other second materials C` D into the main material A. Finally, the user enjoys the well-mixed materials by separating the cap 32 from the engagement end 31A of the body 31 and drinks the well-mixed materials through the first opening 311 directly or by pouring the well-mixed materials into a cup for drinking.

Hence, each sealing plate 332 engages with the partitioning wall 324 to prevent each accommodation room 3231 from communicating with the first accommodation area 312 effectively and separate the main material A and the second materials B` C` D effectively. Further, the material combination can be decided by the user according to needs. The mixing order of the second materials B` C` D with the main material A can also be adjusted by the user. Whereby the variability and selectivity are increased.

To sum up, the improved container of this invention takes advantages that the partitioning wall divides the second accommodation area into the accommodation rooms and each accommodation room is sealed by the sealing plate to prevent each accommodation room from communicating with the first accommodation area. Further, the material combination and the mixing order can be decided at will by separating the relative sealing plate from the partitioning wall to allow the relative accommodation room to communicate with the first accommodation area. Whereby the variability and selectivity are increased.

While the embodiments of this invention are shown and described, it is understood that further variations and modifications may be made without departing from the scope of this invention.

What is claimed is:

1. An improved container comprising a body with an engagement end, a cap connected to said body, and a plurality of operating sets penetrating through said cap and movably inserted into said cap respectively, said body including a first opening enclosed by said engagement end and covered by said cap and a first accommodation area extending downwards from said first opening for accommodating a main material, said cap including a bottom wall, a side wall extending outwards from said bottom wall for engaging with said engagement end, a second accommodation area enclosed by said bottom wall and said side wall, and a partitioning wall extending outwards from said bottom wall to divide said second accommodation area into a plurality of independent accommodation rooms serving for accommodating second materials, each of said plurality of operating sets including a shank movably inserted through a corresponding opening formed in said bottom wall of said cap into a corresponding one of said plurality of accommodation rooms, a sealing plate connected to one end of said shank for engaging with said partition wall, and a head connected to another end of said shank and disposed outside of and separated from said cap, each of said sealing plates engaging with said partition wall at a corresponding engagement position to seal a corresponding one of said plurality of accommodation rooms and to prevent said corresponding accommodation room from communicating with said first accommodation area, said sealing plates allowing said accommodation rooms to communicate with said first accommodation area upon separation from said partitioning wall.

2. The improved container as claimed in claim 1, wherein each of said plurality of operating sets includes a protecting unit removably fitted to said shank and extending from said head to said bottom wall of said cap and thereby impeding movement of said head when said sealing plate of said operating set is placed at said engagement position.

3. The improved container as claimed in claim 1, wherein said heads of said plurality of operating units are on a same level when said sealing plates of said operating sets are respectively placed at said engagement position.

4. The improved container as claimed in claim 1, wherein said plurality of operating sets are configured to be simultaneously actuable.

5. An improved container comprising a body with an engagement end, a cap connected to said body, and a plurality of operating sets penetrating through said cap and movably inserted into said cap respectively, said body including a first opening enclosed by said engagement end and covered by said cap and a first accommodation area extending downwards from said first opening for accommodating a main material, said cap including a bottom wall, a side wall extending outwards from said bottom wall for engaging with said engagement end, a second accommodation area enclosed by said bottom wall and said side wall, and a partitioning wall extending outwards from said bottom wall to divide said second accommodation area into a plurality of independent accommodation rooms serving for accommodating second materials, each of said plurality of operating sets including a shank movably inserted through a corresponding opening formed in said bottom wall of said cap into a corresponding one of said plurality of accommodation rooms, a sealing plate connected to one end of said shank for engaging with said partition wall, a head connected to another end of said shank and disposed outside of and separated from said cap, and a protecting unit removably fitted to said shank between said head and said cap, said plurality of operating sets being configured to be simultaneously actuable, each of said sealing plates engaging with said partition wall at a corresponding engagement position to seal a corresponding one of said plurality of accommodation rooms and to prevent said corresponding accommodation room from communicating with said first accommodation area, each of said protecting units extending from a corresponding one of said heads to said bottom wall of said cap and thereby impeding movement of said corresponding head when each said sealing plate is placed at said corresponding engagement position, said sealing plates allowing said accommodation rooms to communicate with said first accommodation area upon separation from said partitioning wall.

6. The improved container as claimed in claim 5, wherein said heads of said plurality of operating units are on a same level when said sealing plates of said operating sets are respectively placed at said engagement position.

7. An improved container comprising a body with an engagement end, a cap connected to said body, and a plurality of operating sets penetrating through said cap and movably inserted into said cap respectively, said body including a first opening enclosed by said engagement end and covered by said cap and a first accommodation area extending downwards from said first opening for accommodating a main material, said cap including a bottom wall, a side wall extending outwards from said bottom wall for engaging with said engagement end, a second accommodation area enclosed by said bottom wall and said side wall, and a partitioning wall extending outwards from said bottom wall to divide said second accommodation area into a plurality of independent accommodation rooms serving for accommodating second materials, each of said plurality of operating sets including a shank movably inserted through a corresponding opening formed in said bottom wall of said cap into a corresponding one of said plurality of accommodation rooms, a sealing plate connected to one end of said shank for engaging with said partition wall, a head connected to another end of said shank and disposed outside of and separated from said cap, and a protecting unit removably fitted to said shank between said head and said cap, each of said sealing plates engaging with said partition wall at a corresponding engagement position to seal a corresponding one of said plurality of accommodation rooms and to prevent said corresponding accommodation room from communicating with said first accommodation area, each of said protecting units extending from a corresponding one of said heads to said bottom wall of said cap and thereby impeding movement of said corresponding head when each said sealing plate is placed at said corresponding engagement position, said sealing plates allowing said accommodation rooms to communicate with said first accommodation area upon separation from said partitioning wall.

8. The improved container as claimed in claim 7, wherein said heads of said plurality of operating units are on a same level when said sealing plates of said operating sets are respectively placed at said engagement position.

* * * * *